US008783779B2

(12) United States Patent
Wittenberg et al.

(10) Patent No.: US 8,783,779 B2
(45) Date of Patent: Jul. 22, 2014

(54) KNOCK-DOWN STOOL

(71) Applicant: Target Brands, Inc., Minneapolis, MN (US)

(72) Inventors: Katherine R. Wittenberg, St. Paul, MN (US); Sara L. Pedersen, Minneapolis, MN (US); Chad M. Bogdan, Saint Paul, MN (US); George K. Smithwick, Blaine, MN (US)

(73) Assignee: Target Brands, Inc., Minneapolis, MN (US)

( * ) Notice: Subject to any disclaimer, the term of this patent is extended or adjusted under 35 U.S.C. 154(b) by 51 days.

(21) Appl. No.: 13/682,244

(22) Filed: Nov. 20, 2012

(65) Prior Publication Data

US 2014/0138994 A1 May 22, 2014

(51) Int. Cl.
*A47C 7/00* (2006.01)
*A47C 31/11* (2006.01)

(52) U.S. Cl.
CPC ..... *A47C 31/11* (2013.01)
USPC ..... 297/440.1; 297/228.1; 297/461

(58) Field of Classification Search
USPC ..... 297/228.1, 140.3, 440.1, 3, 440.22, 297/440.12, 140, 461; 108/150; 224/155; 206/326; 248/405
See application file for complete search history.

(56) References Cited

U.S. PATENT DOCUMENTS 1,712,412 A 5/1929 Westerman
2,265,841 A * 12/1941 Jankowski ..... 297/440.22
2,449,017 A 9/1948 Smiler
2,577,741 A 12/1951 Creveling et al.
2,742,953 A * 4/1956 Kudrna ..... 248/405
2,925,851 A * 2/1960 Weiss ..... 297/119
3,023,050 A 2/1962 Jensen
3,382,001 A 5/1968 Schafer et al.
3,425,764 A 2/1969 Budd
3,430,588 A 3/1969 Heyer
3,663,058 A 5/1972 Hirsch
3,892,441 A 7/1975 Roeshman
3,913,154 A * 10/1975 Sweeney ..... 5/186.1
4,181,991 A * 1/1980 Morgan et al. ..... 5/400
D274,676 S 7/1984 Massonnet
4,565,403 A * 1/1986 Brown ..... 297/3
4,810,031 A 3/1989 Patterson
5,186,372 A * 2/1993 Biedenharn, Jr. ..... 224/155

(Continued)

FOREIGN PATENT DOCUMENTS

GB 2026312 A 2/1980

OTHER PUBLICATIONS

Woman's Day, "How to Make Fitted Stool Covers," http://www.womansday.com/home/craft-ideas/how-to-make-fitted-stool-covers-65364, 2 pages, at least as early as Aug. 2012.

(Continued)

*Primary Examiner* — Chi Q Nguyen
(74) *Attorney, Agent, or Firm* — Leanne Taveggia Farrell; Westman, Champlin & Koehler, P.A.

(57) ABSTRACT

A stool includes an internal frame including a base, a seat and a plurality of stiles coupling the base to the seat. A sling material is stretched between and coupled to opposing sides of the seat. A slipcover fits over the internal frame and includes an end panel and a plurality of side panels that define an open end located opposite the end panel. The end panel includes a padded cushion that rests on top of the sling material.

18 Claims, 9 Drawing Sheets

(56) References Cited

U.S. PATENT DOCUMENTS

| | | | | |
|---|---|---|---|---|
| 5,445,301 | A * | 8/1995 | Biedenharn, Jr. | 224/155 |
| D379,950 | S | 6/1997 | Davis | |
| D393,373 | S | 4/1998 | Acosta | |
| 5,833,333 | A * | 11/1998 | Brown | 312/235.1 |
| 6,296,314 | B1 | 10/2001 | Klein | |
| 6,467,843 | B1 * | 10/2002 | Rossborough | 297/344.18 |
| D465,663 | S | 11/2002 | Ramirez | |
| 6,749,265 | B1 * | 6/2004 | Wang | 297/440.1 |
| D495,522 | S | 9/2004 | Sanchez | |
| D580,666 | S | 11/2008 | Sempe | |
| 7,475,442 | B1 | 1/2009 | Dierking et al. | |
| D610,818 | S | 3/2010 | Crane | |
| 7,722,123 | B2 * | 5/2010 | Holland | 297/440.1 |
| 8,231,301 | B1 | 7/2012 | Joyce | |
| 2013/0320727 | A1 * | 12/2013 | Martin et al. | 297/270.1 |

OTHER PUBLICATIONS

Office Action from Canadian Patent Application No. 2,810,531, mailed Jul. 16, 2013 (2 pages).

Hastings, Pamela, J., "Simple-to-sew Slipcovers & Cover-ups", New York: Sterling Publishing Co., 5 pages, available at least as early as Oct. 2002.

* cited by examiner

KNOCK-DOWN STOOL

BACKGROUND

Outdoor furniture can be purchased in a flat-pack format. Flat-pack furniture, also known as knock-down furniture, is shipped disassembled and packaged in a flat box. Not only does the box contain the pieces and hardware needed for assembling the furniture, but the box also contains instructions and, in some instances, simple tools for assembly. While some pieces of outdoor furniture are more conducive to being manufactured for flat-packing, such as tables or chairs that receive removable cushions, other pieces of outdoor furniture are less conducive, such as upholstered furniture.

The discussion above is merely provided for general background information and is not intended to be used as an aid in determining the scope of the claimed subject matter.

SUMMARY

A stool includes an internal frame including a base, a seat and a plurality of stiles coupling the base to the seat. A sling material is stretched between and coupled to opposing sides of the seat. A slipcover fits over the internal frame and includes an end panel and a plurality of side panels that define an open end located opposite the end panel. The end panel includes a padded cushion that rests on top of the sling material.

A seat includes a skeleton having a rectilinear bottom, a rectilinear top and a plurality of legs connecting the rectilinear bottom to the rectilinear top. A protective cover fits over the skeleton and includes a top having a padded cushion, a plurality of sides and an open bottom that is located opposite from the top. The protective cover further comprises at least one pair of straps. The pair of straps are attached to opposing sides of the protective cover and to each other to secure the protective cover tight against the skeleton.

To assemble the stool or seat, first ends of the plurality of stiles are mounted to the base and opposing second ends of the plurality of stiles are mounted to the seat to form an internal frame. The seat includes a sling material stretched between and coupled to opposing sides of the seat. The internal frame is covered with the slipcover that includes the end panel, the plurality of side panels and the open end located opposite the end panel. The end panel includes the padded cushion that sits adjacent to the sling material.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Embodiments of the disclosure pertain to a knock-down or a flat-pack furnishing that is assembled into a stool. The knock-down stool has the look and feel of being fully upholstered and is for use in outdoor or patio applications. For example, the knock-down stool can be used as seating around an outdoor dining table. The stool includes an internal frame having a seat, a sling material stretched between opposing sides of the seat and a slipcover that fits over the internal frame and includes a padded cushion that sits on top of the sling material.

Outdoor furniture or patio furniture, especially outdoor seating furnishings, commonly incorporate sling material or fabric as part of their design because of its desirable characteristics of being able to dry quickly, being able to withstand inclement weather conditions and being able to be easily cleaned. Sling patio furniture is constructed by stretching synthetic fabric between wood or metal frame members of a chair to provide a seat and a seat back. Typically, sling material or fabric is made of a synthetic material, such as polyester coated with a vinyl layer for added weather protection.

The outdoor stool described herein not only provides an upholstered furnishing that can withstand harsh outdoor environments, but it also includes two layers or a double layer of cushioning. The first layer is a sling material stretched between opposing sides of the seat of the internal frame. This first layer of cushioning provides a comfortable surface that evenly distributes weight without the need for further structural elements. The second layer of cushioning is a padded cushion located in a slipcover that fits over the internal frame of the stool and sits on top of the first layer of cushioning.

Figure 1:
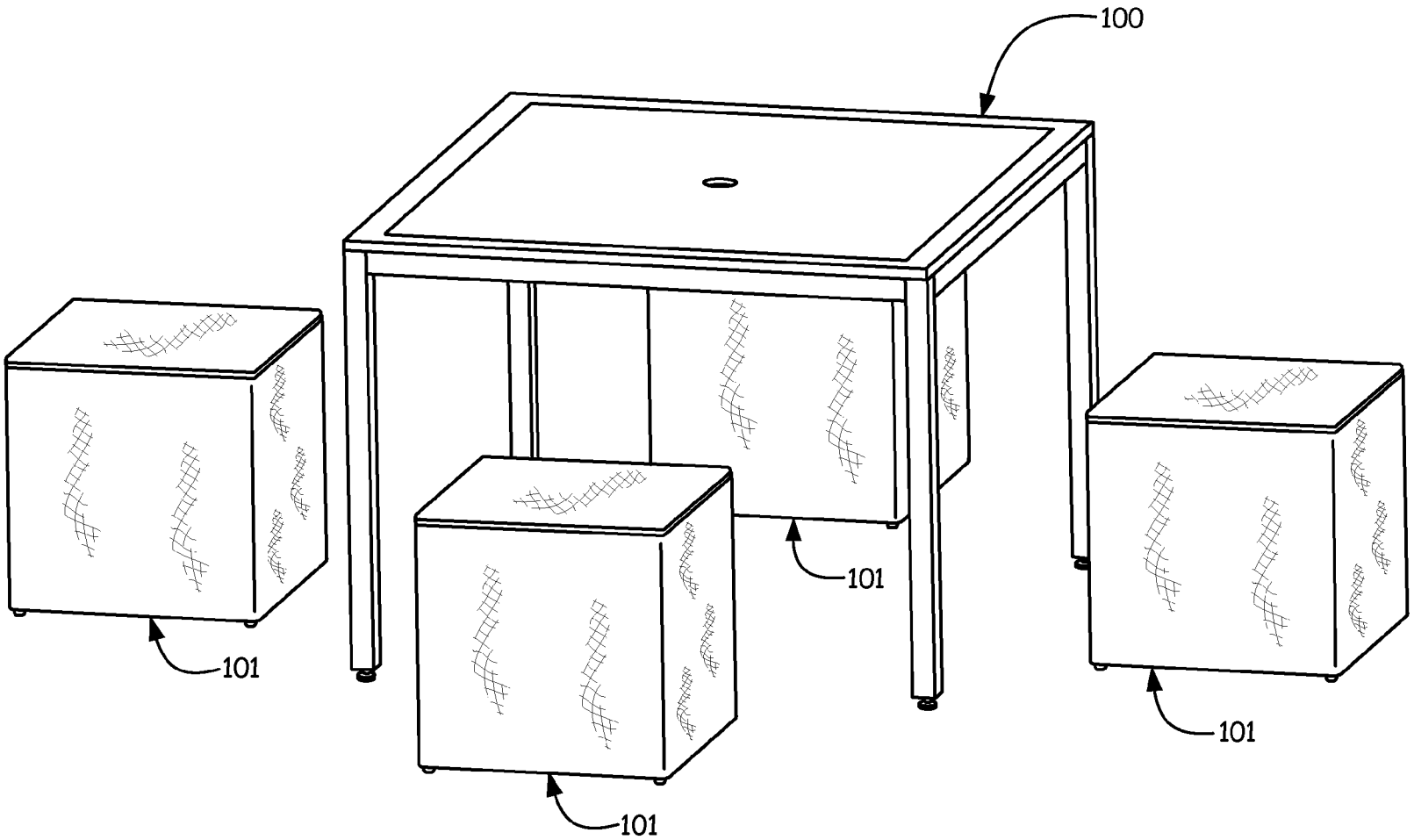
FIG. 1 is a perspective view of a collection of outdoor furniture including a plurality of stools and a table according to one embodiment.
Figure 2:
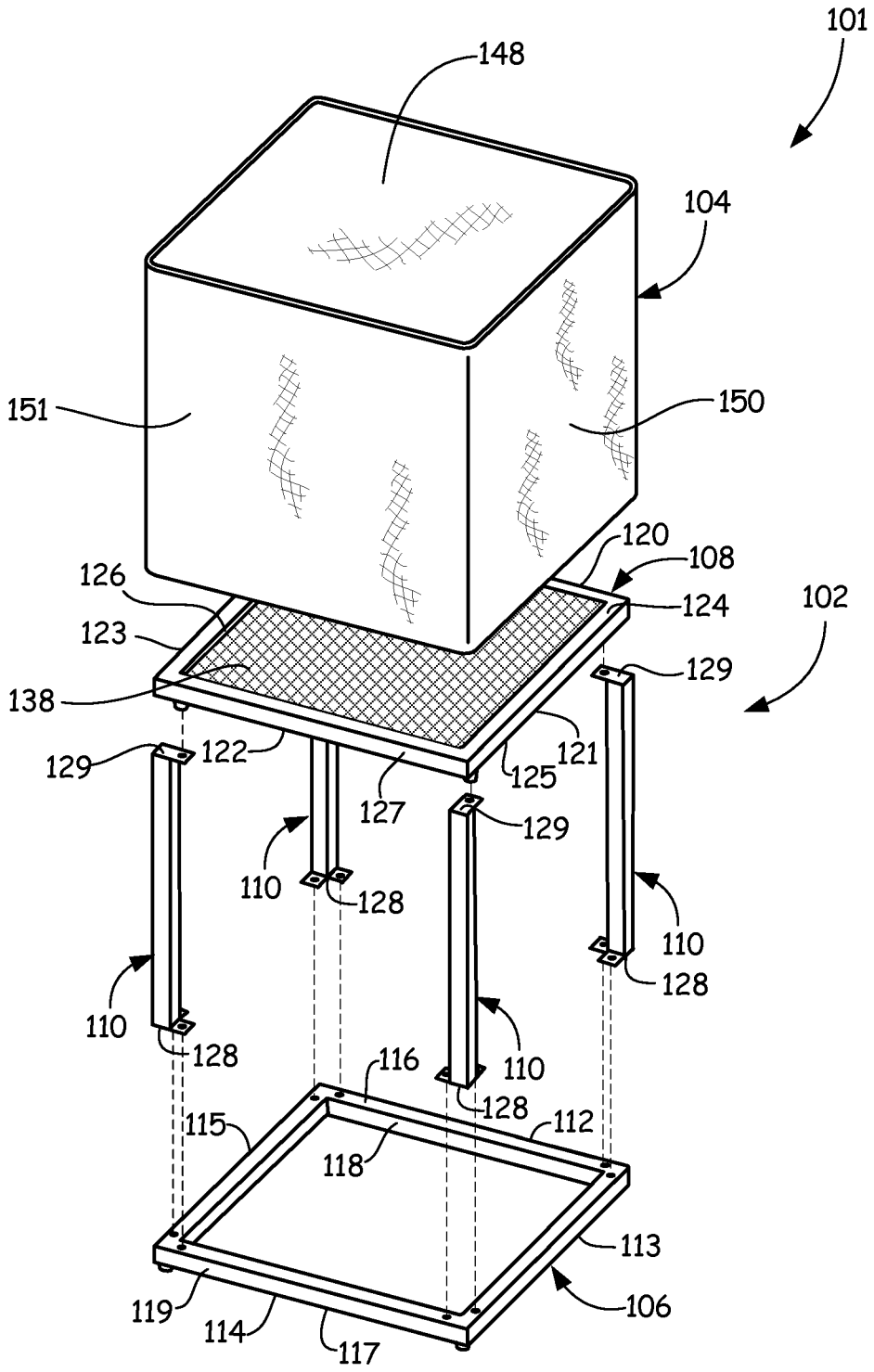
FIG. 2 is an exploded perspective view of the one of the stools illustrated in FIG. 1.

FIG. 1 illustrates a perspective view of a knock-down patio furniture set including a table 100 and a plurality of stools 101. Each stool 101 is a single seat that is backless and armless. However, it should be recognized that stools 100 could be seats that have a back or have a back and arms. FIG. 2 illustrates an exploded perspective view of one of the stools 101. As illustrated, stool 101 includes an internal frame or skeleton 102 and a slipcover or protective cover 104 that fits over internal frame 102. Internal frame or skeleton 102 includes a base or bottom 106, a seat or top 108 and a plurality of stiles or legs 110 that couple base 106 to seat 108.

In one embodiment, base 106 includes a rectilinear shape, such as a square, having four sides 112, 113, 114 and 115, a top surface 116, a bottom surface 117, an inner facing surface 118 and an outer facing surface 119. It should be understood, however, base 106 can include other types of shapes other than the shape illustrated in the figures. In addition, seat 108 includes a rectilinear shape, such as a square, having four sides 120, 121, 122 and 123, a top surface 124, a bottom surface 125, an inner facing surface 126 and an outer facing surface 127. Like base 106, seat 108 can include other types of shapes other than the shape illustrated in the figures. In one embodiment and as illustrated in the figures, dimensions of sides 112, 113, 114 and 115 of base 106 substantially match dimensions of sides 120, 121, 122 and 123 of seat 108.

Figure 3:
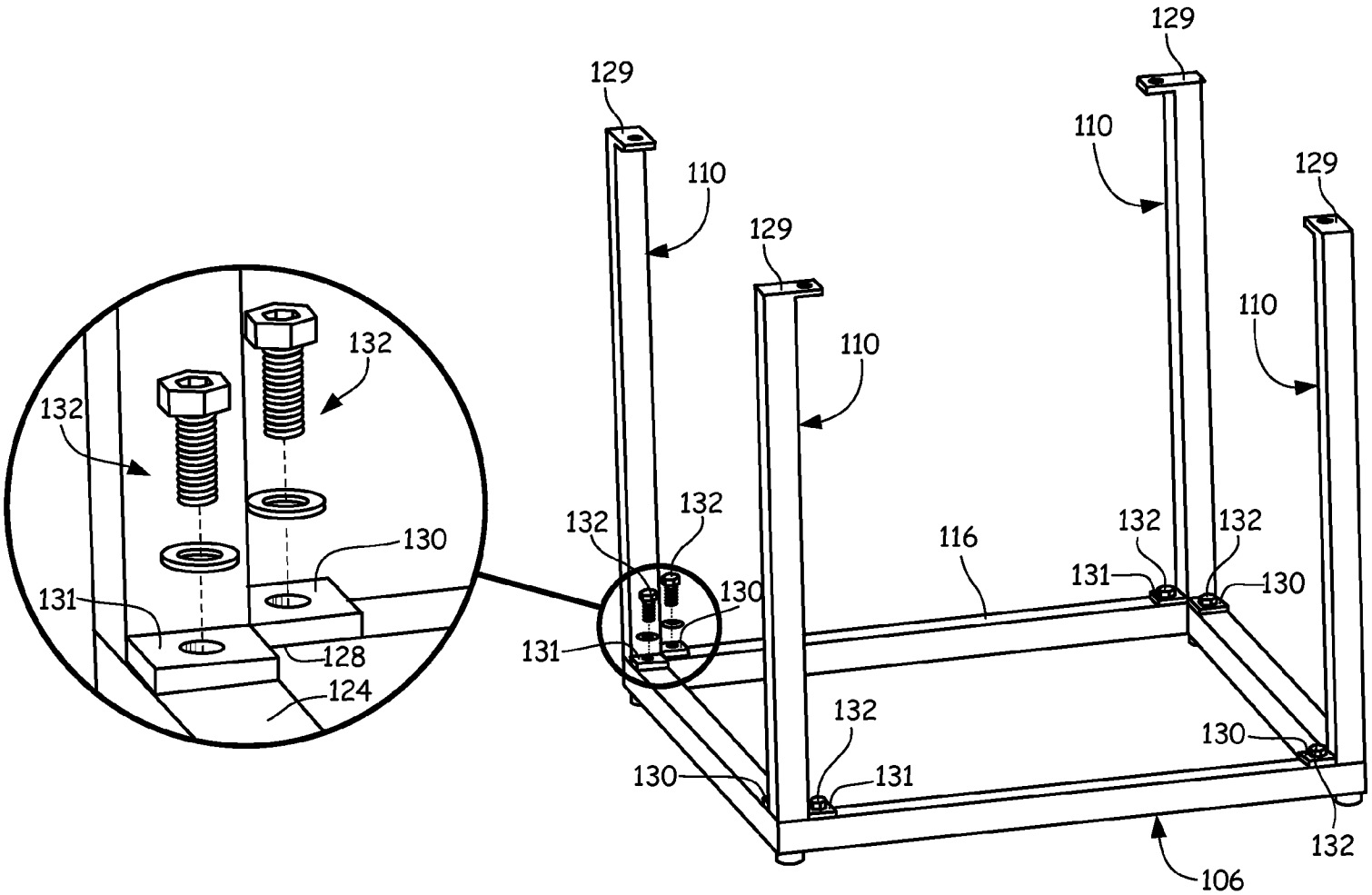
FIG. 3 is a perspective view of mounting the legs to a base of an internal frame of the stool illustrated in FIG. 2 according to one embodiment.
Figure 4:
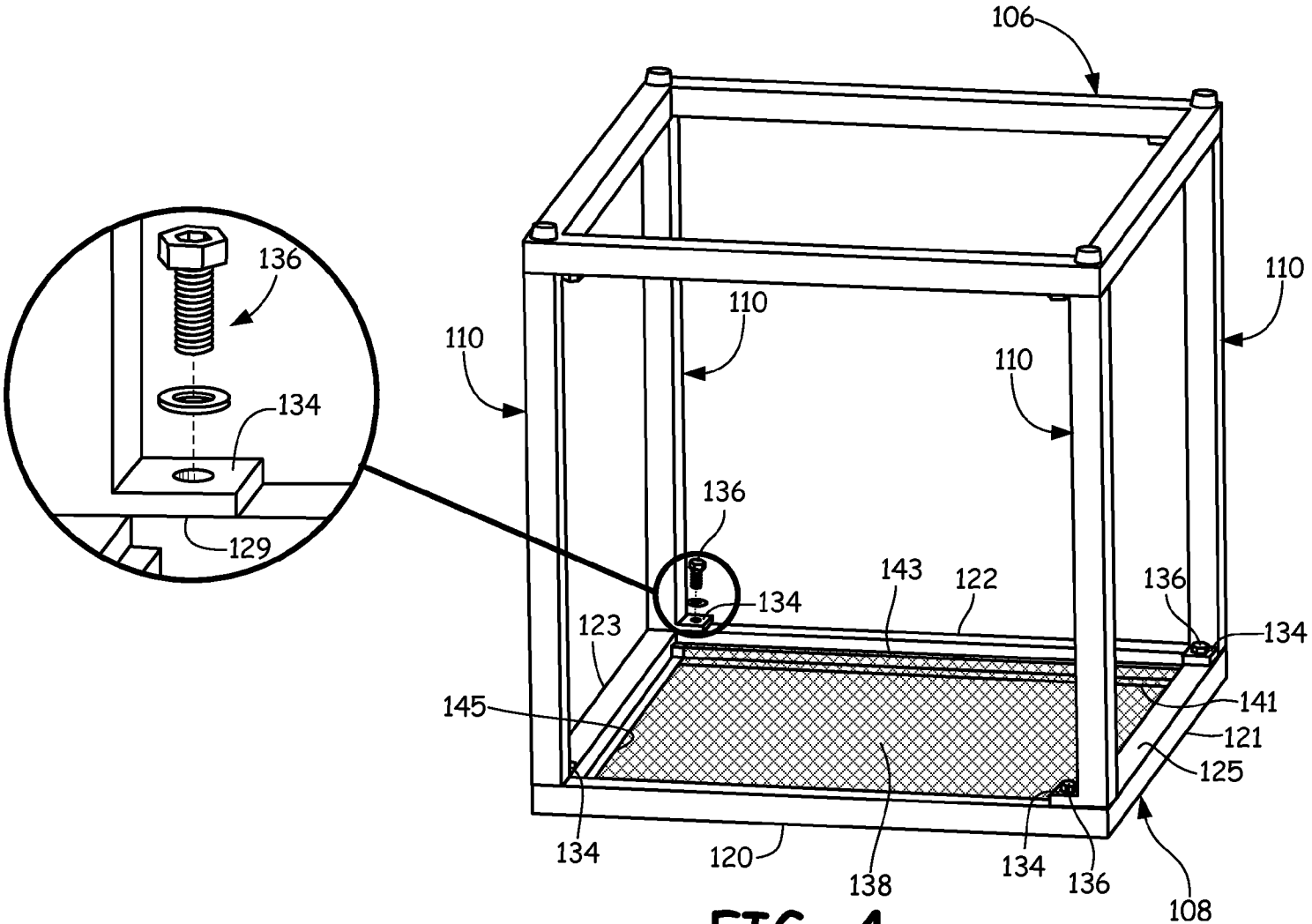
FIG. 4 is a perspective view of mounting the seat of the internal frame to the legs of the stool illustrated in FIG. 2 according to one embodiment.

Stiles or legs 110 that couple base 106 to seat 108 include first ends 128 and second ends 129. As illustrated in FIGS. 2-4 and under one embodiment, first ends 128 and second ends 129 of stiles 110 include flanges for mounting to surfaces of base 106 and seat 108. FIG. 3 illustrates a perspective view including an enlarged view of first ends 128 of stiles 110 being mounted to base 106. In particular, first ends 128 of stiles 110 includes a pair of flanges 130 and 131 that are oriented at substantially right angles from each other and are mounted to top surface 116 of base 106. Each flange 130 and 131 includes an aperture for receiving a fastener 132 that secures flanges 130 and 131 and therefore each stile 110 to top surface 116 of base 106. As illustrated in the figures and under one embodiment, fastener 132 includes a screw and washer.

FIG. 4 illustrates a perspective view including an enlarged view of second ends 129 of stiles 110 being mounted to seat 108. In particular, each second end 129 of stiles 110 includes a single flange 134 that is mounted to bottom surface 125 of seat 108. Each flange 134 includes an aperture for receiving a fastener 136 that secures flanges 134 and therefore each stile 110 to bottom surface 125. As illustrated in the figures and under one embodiment, fastener 136 includes a screw and washer.

Figure 9:
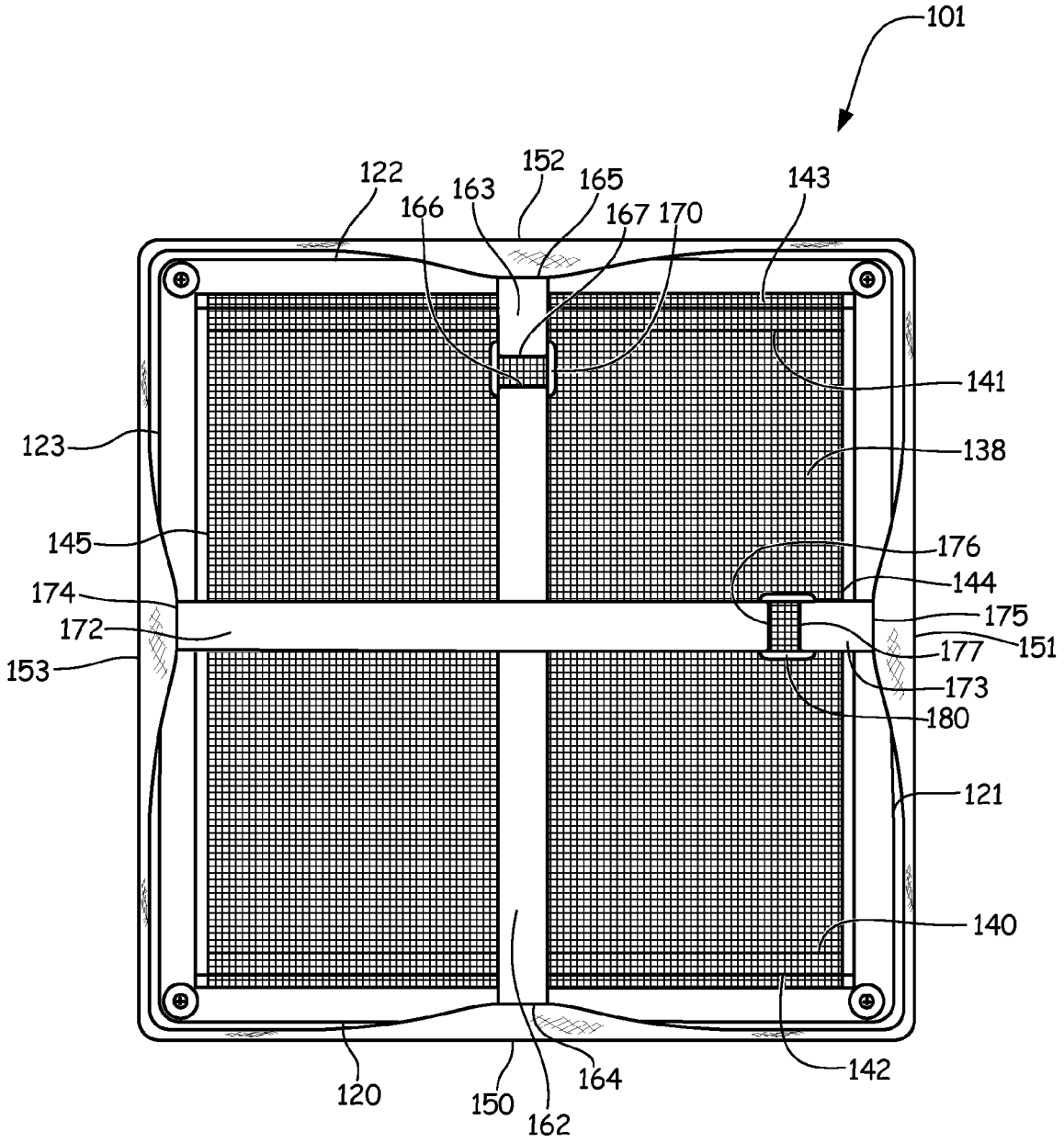
FIG. 9 is a bottom view of the stool illustrated in FIG. 2.

As shown in FIGS. 2, 4 and in the bottom view as illustrated in FIG. 9, stool 101 further includes a sling material 138 that is stretched between and coupled to opposing sides of seat 108. As illustrated in FIGS. 2, 4 and 9, sling material 138 is stretched between and coupled to opposing sides 120 and 122 of seat 108. In one embodiment, sling material 138 is made of vinyl-coated polyester, such as a polyvinyl chloride (PVC) coated polyester.

In one embodiment, opposing ends 140 and 141 of sling material 138 are hemmed. Then, a portion of sling material 138 that is adjacent end 140 is folded over a first bar or support piece 142 and attached to side 120 of seat 108 and a portion of sling material 138 that is adjacent end 141 is folded over a second bar or support piece 143 and attached to side 122 of seat 108. In this way, ends 140 and 141 are held tight against opposing sides of seat 108, while opposing ends 144 and 145, which are hemmed, are free ends that are not connected to seat 108.

Figure 5:
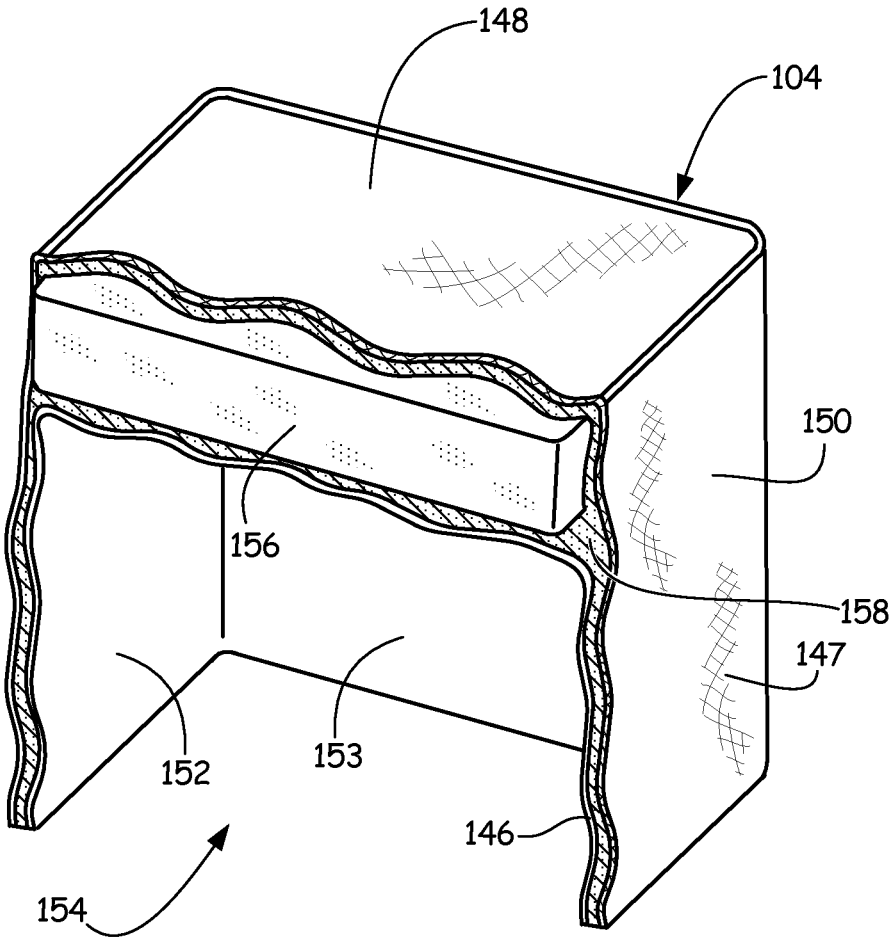
FIG. 5 is a perspective cutaway view of a slipcover of the stool illustrated in FIG. 2.

FIG. 5 illustrates a cut away perspective view of slipcover or protective cover 104. Slipcover 104 includes an inner fabric or interior material 146, an outer fabric or exterior material 147, an end panel 148 and a plurality of side panels 150, 151, 152 and 153 that define an open end 154 located opposite end panel 148. Although side panel 151 is cut away in FIG. 5, side panel 151 is illustrated in FIG. 2. In addition, inner fabric 146 is made of a non-woven and fade resistant material, outer fabric 147 is made of a fade resistant patterned material and the inner dimensions of slipcover 104 are only slightly larger than the outer dimensions of internal frame 102 so that slipcover can be easily fit over internal frame 102, yet still not be loose.

As clearly illustrated in FIG. 5, end panel 148 includes a padded cushion 156 that is located between inner fabric 146 and outer fabric 147. An exemplary padded cushion 156 is made of foam. In addition, encased between inner fabric 146 and outer fabric 147 is a fill 158 that, in one exemplary embodiment, can be made of polyester batting. For side panels 150, 151, 152 and 153, only fill 158 is located between inner fabric 146 and outer fabric 147, whereas for end panel 148, fill 158 surrounds padded cushion 156 and is located between inner fabric 146 and padded cushion 156 and also located between outer fabric 147 and padded cushion 156. In this way, fill 158 keeps padded cushion 156 in place within end panel 148.

Figure 6:
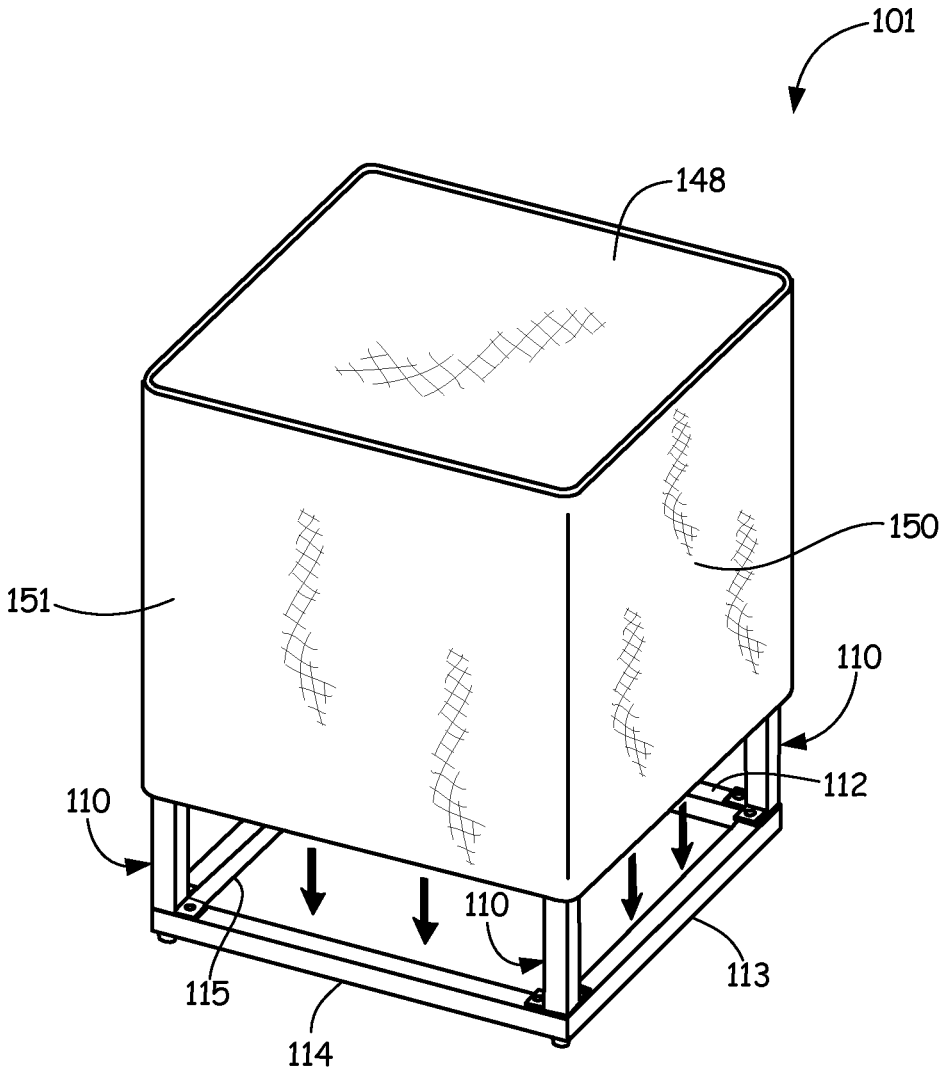
FIG. 6 is a perspective view of fitting the slipcover over the internal frame of the stool illustrated in FIG. 2.

As illustrated in the perspective view of FIG. 6 and as discussed above, slipcover 104 is fitted over or pulled over assembled internal frame 104 such that end panel 148 is located adjacent seat 108, side panel 150 extends between stiles 110 that are mounted to side 113, side panel 151 extends between stiles 110 that are mounted to side 114, side panel 152 extends between stiles 110 that are mounted to side 115 and side panel 153 extends between stiles 110 that are mounted to side 112. Because end panel 148 is adjacent seat 108, padded cushion 156 is located adjacent sling material 138 or rests on sling material 138. As described above, when a user sits on stool 101, they will be cushioned by two layers of cushioning. The first layer is padded foam cushion 156 located in slipcover 104. The second layer is provided by sling material 138. Sling material 138 provides a support that not only evenly distributes the weight of the user over seat 108, but sling material 138 also evenly distributes the weight of the user over padded foam cushion 156. The even distribution of weight provides for comfortable seating without feeling the frame members of internal frame 102 underneath the user.

Figure 7:
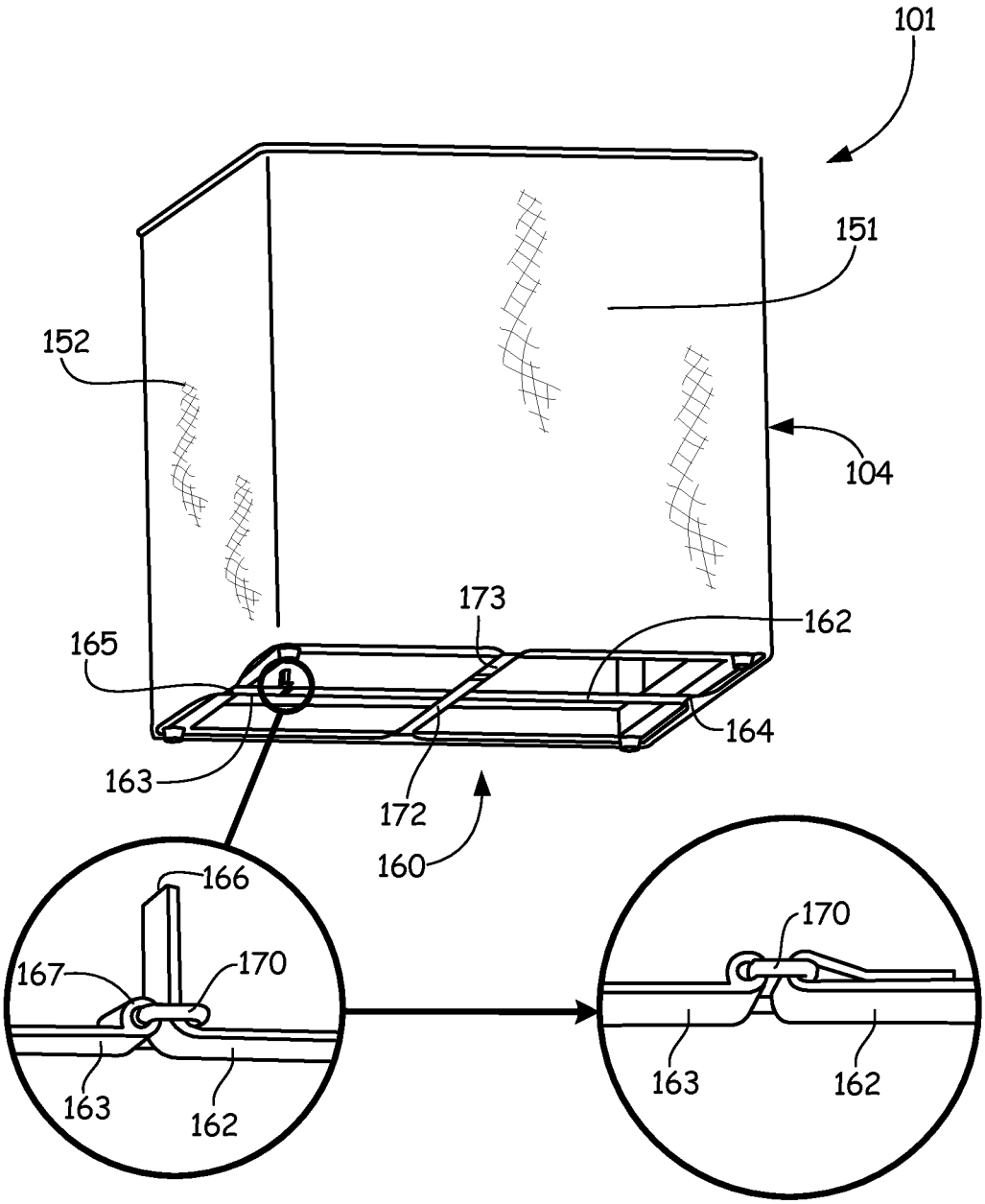
FIG. 7 is a bottom perspective view of securing the slipcover to the internal frame of the stool illustrated in FIG. 2 according to one embodiment.
Figure 8:
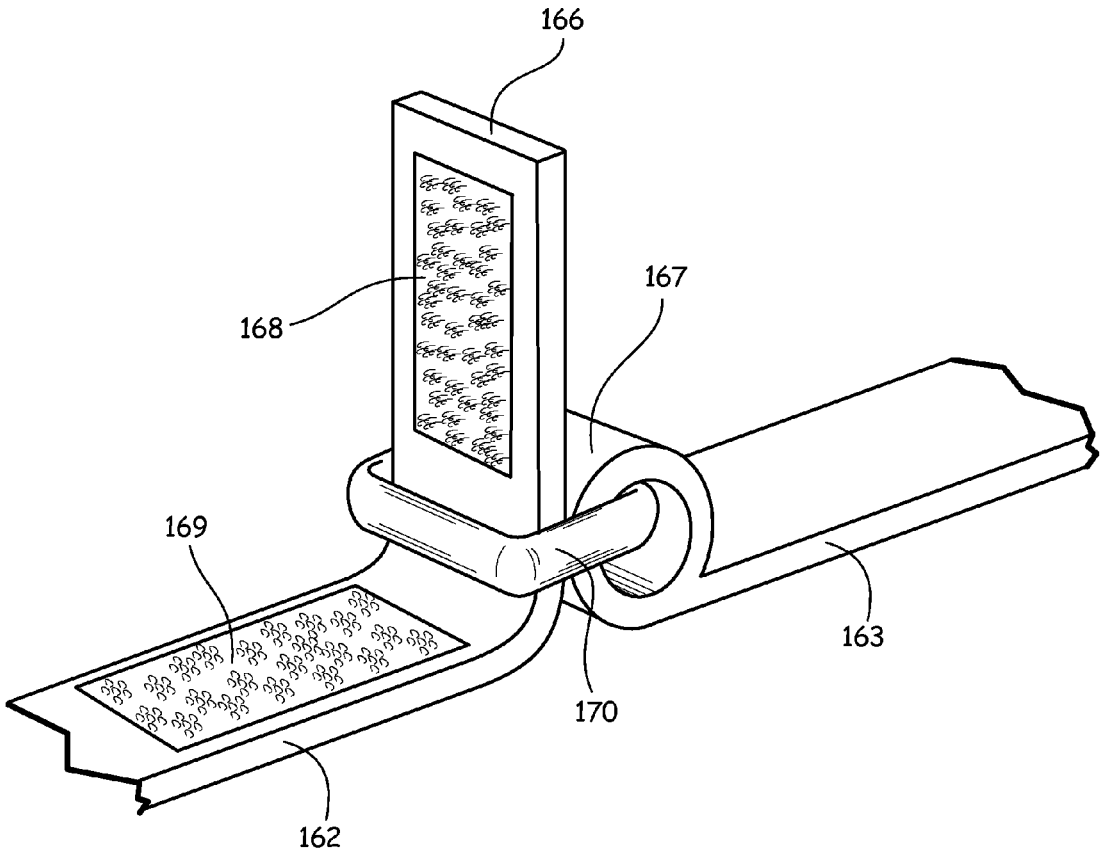
FIG. 8 is an enlarged alternative view of securing the slipcover to the internal frame of the stool as illustrated in FIG. 7.

FIG. 7 illustrates a bottom perspective view of stool 101 including enlarged views of a fastening mechanism 160. FIG. 8 illustrates an enlarged view of fastening mechanism 180 as illustrated in FIG. 7, but from a different view. FIG. 9 illustrates a bottom view of stool 101. Fastening mechanism 160 of slipcover 104 secures edges of side panels 150, 151, 152 and 153 of slipcover 104 that define open end 154 to internal frame 102. Although fastening mechanism 160 keeps internal frame 102 from falling out of slipcover 104, fastening mechanism 160 does not directly connect or couple to frame 102.

Fastening mechanism 160 includes at least one pair of straps 162 and 163 having first ends 164 and 165 and second ends 166 and 167. First ends 164 and 165 are secured, for example by stitching, to edges of opposing side panels 150 and 152. Second ends 166 and 167 mate together to secure slipcover 104 around internal frame 102.

In one embodiment and as illustrated in FIGS. 7 and 8, second end 166 of strap 162 includes a piece of hook material 168 and a piece of loop material 169. In some embodiments, hook material 168 is spaced apart form loop material 169 as is illustrated in FIG. 8, but in other embodiments, hook material 168 and loop material are positioned adjacent to each other along a side of strap 162. Although hook material 168 is illustrated as being located closer to second end 166 than loop material 169, it should be realized that in alternative embodiments loop material 169 can be located closer to second end 166 than hook material 168.

Second end 167 of strap 163 is coupled to a webbing ring 170. In one embodiment, second end 167 of strap 163 is folded over, and for example stitched together, to create a loop for holding webbing ring 170. To secure straps 162 and 163 together so as to secure slipcover 104 to internal frame 102, second end 166 of strap 162 is inserted through webbing ring 170 so that webbing ring 170 is located between hook material 168 and loop material 169 or located such that at least a portion of hook material 168 is located on one side of webbing ring 170 and at least a portion of loop material 169 is located on the other side of webbing ring 170. Second end 166 of strap 162 is folded back onto itself to engage or mate hook material 168 with loop material 169. Before mating hook material 168 with loop material 169, strap 162 should be pulled so that opposing side panels 150 and 152 are tight against internal frame 102.

In another embodiment, fastening mechanism 160 includes first pair of straps 162 and 163 as described above and a second pair of straps 172 and 173. Straps 172 and 173 include first ends 174 and 175 and second ends 176 and 177. First ends 174 and 175 are secured, for example by stitching, to edges of opposing side panels 151 and 153. Second ends 176 and 177 mate together to further secure slipcover 104 around internal frame 102.

In one embodiment and not specifically illustrated, second end 176 of strap 172 includes a piece of hook material and a piece of loop material similar to second end 166 of strap 162. In some embodiments, the hook material is spaced apart form loop material, but in other embodiments, the hook material and the loop material are positioned adjacent to each other along a side of strap 172. Although the hook material can be located closer to second end 176 than the loop material, it should be realized that in alternative embodiments the loop material can be located closer to second end 176 than the hook material.

Second end 177 of strap 173 is coupled to a webbing ring 180. In one embodiment, second end 177 of strap 173 is folded over, and for example stitched together, to create a loop for holding webbing ring 180. To secure straps 172 and 173 together so as to further secure slipcover 104 to internal frame 102, second end 176 of strap 172 is inserted through webbing ring 180 so that webbing ring 180 is located between the hook material and the loop material or located such that at least a portion of the hook material is located on one side of webbing ring 180 and at least a portion of the loop material is located on the other side of webbing ring 180. Second end 176 of strap 172 is folded back onto itself to engage or mate the hook material with the loop material. Before mating the hook material with the loop material, strap 172 should be pulled so that opposing side panels 151 and 153 are tight against internal frame 102.

Although fastening mechanism 160 may consist of only one pair of straps that would pull opposing sides of slipcover 104 tight against internal frame 102, fastening mechanism 160 is better served consisting of a second pair of straps that would also pull the other opposing sides of slipcover 104 tight against internal frame 102. In addition, it is possible that fastening mechanism can include four or more pairs of straps for tightening side panels 150, 151, 152 and 153 against internal frame 102.

FIGS. 3-4 and 6-9 illustrate a method of assembling a knock down stool 101 that has the look and feel of an upholstered furnishing for the outdoors. First ends 128 of a plurality of stiles or legs 110 are mounted to a base 106 using simple hardware and simple tools and a seat 108 is mounted to opposing ends 129 of the plurality of stiles using simple hardware and simple tools to form an internal frame 102 of stool 101. As described above, seat 108 includes a sling material 138 stretched between and coupled to opposing sides 120 and 122 of seat 108. Internal frame 102 is then covered with a slipcover 104 that includes an end panel 148, a plurality of side panels 150, 151, 152 and 153 and an open end 154 located opposite the end panel 148. End panel 148 includes a padded cushion 156 that sits on top of or adjacent to sling material 138.

Slipcover 104 is secured to internal frame 102 using at least one pair of straps that are coupled to edges of open end 154 of slipcover 104. To secure slipcover 104 to internal frame 102 an end of first strap 162 or 172 of the pair of straps is inserted or threaded through a webbing ring 170 or 180 located at an end of a second strap 163 or 173 of the pair of straps and a piece of a hook material located on the first strap 162 or 172 is connected to or mated with a piece of loop material also located on the first strap 162 or 172. In one embodiment, straps 162 and 163 are coupled to opposing edges of open end 154 of slipcover 104 and straps 172 and 173 are coupled to different opposing edges of the open end 154 of slipcover 104.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A stool comprising:

an internal frame including a base, a seat and a plurality of stiles coupling the base to the seat;

a sling material stretched between and coupled to opposing sides of the seat;

a slipcover that fits over the internal frame and includes an end panel and a plurality of side panels that define an open end located opposite the end panel, the end panel including a padded cushion that rests on top of the sling material; and wherein the slipcover comprises a fastening mechanism, the fastening mechanism secures edges of the plurality of side panels that define the open end of the slipcover to the internal frame.

2. The stool of claim 1, wherein the slipcover comprises an inner fabric and an outer fabric, wherein the cushion of the end panel of the slipcover is positioned between the inner fabric and the outer fabric of the end panel.

3. The stool of claim 2, wherein the slipcover further comprises a fill located between the inner fabric and the outer fabric and surrounding the cushion.

4. The stool of claim 1, wherein the fastening mechanism comprises at least one pair of straps, wherein first ends of the straps are secured to edges of opposing side panels of the slipcover and second ends of the straps mate together to secure the slipcover around the internal frame.

5. The stool of claim 4, wherein the fastening mechanism comprises two pairs of straps.

6. The stool of claim 4, wherein a first strap of the pair of straps comprises a piece of hook material and a piece of loop material and a second strap of the pair of straps comprises a webbing ring coupled to the second end of the second strap, wherein the second end of the first strap is inserted through the webbing ring and is folded back to mate the hook material on the first strap with the loop material on the first strap.

7. The stool of claim 1, wherein the base comprises a rectilinear shape and wherein the seat comprises a rectilinear shape and wherein dimensions of the base substantially match dimensions of the seat.

8. The stool of claim 1, wherein the sling material comprises a vinyl-coated polyester.

9. A method of assembling a stool comprising:

mounting first ends of a plurality of stiles to a base and mounting a seat to opposing second ends of the plurality of stiles to form an internal frame, wherein the seat includes a sling material stretched between and coupled to opposing sides of the seat;

covering the internal frame with a slipcover that includes an end panel, a plurality of side panels and an open end located opposite the end panel, the end panel including a padded cushion that sits adjacent to the sling material;

securing the slipcover to the internal frame using at least one pair of straps that are coupled to edges of the open end of the slipcover; and wherein securing the slipcover to the internal frame comprises threading a first strap of the pair of straps through a webbing ring located at an end of a second strap of the pair of straps.

10. The method of claim 9, further comprising connecting a piece of a hook material located on the first strap with a piece of loop material also located on the first strap.

11. The method claim 9, further comprising using a first pair of straps to couple opposing edges of the open end of the slipcover and using a second pair of straps to couple different opposing edges of the open end of the slipcover.

12. A stool comprising:

an internal frame including a base, a seat and a plurality of stiles coupling the base to the seat;

a sling material stretched between and coupled to opposing sides of the seat;

a slipcover that fits over the internal frame and includes an end panel and a plurality of side panels that define an open end located opposite the end panel, the end panel including a padded cushion that rests on top of the sling material;

wherein the slipcover comprises an inner fabric and an outer fabric;

wherein the cushion of the end panel of the slipcover is positioned between the inner fabric and the outer fabric of the end panel; and wherein the slipcover comprises a fill located between the inner fabric and the outer fabric and surrounding the cushion.

13. The stool of claim 12, wherein the slipcover comprises a fastening mechanism, the fastening mechanism secures edges of the plurality of side panels that define the open end of the slipcover to the internal frame.

14. The stool of claim 13, wherein the fastening mechanism comprises at least one pair of straps, wherein first ends of the straps are secured to edges of opposing side panels of the slipcover and second ends of the straps mate together to secure the slipcover around the internal frame.

15. The stool of claim 14, wherein the fastening mechanism comprises two pairs of straps.

16. The stool of claim 14, wherein a first strap of the pair of straps comprises a piece of hook material and a piece of loop material and a second strap of the pair of straps comprises a webbing ring coupled to the second end of the second strap, wherein the second end of the first strap is inserted through the webbing ring and is folded back to mate the hook material on the first strap with the loop material on the first strap.

17. The stool of claim 12, wherein the base comprises a rectilinear shape and wherein the seat comprises a rectilinear shape and wherein dimensions of the base substantially match dimensions of the seat.

18. The stool of claim 12, wherein the sling material comprises a vinyl-coated polyester.

* * * * *